United States Patent [19]

Bruchet

[11] 4,129,762

[45] Dec. 12, 1978

[54] CIRCUIT-BREAKER OPERATING MECHANISM

[75] Inventor: Michel Bruchet, Saint-Quentin, France

[73] Assignee: Societe Anonyme dite: UNELEC, Paris, France

[21] Appl. No.: 817,527

[22] Filed: Jul. 19, 1977

[30] Foreign Application Priority Data

Jul. 30, 1976 [FR] France ..... 76 23375

[51] Int. Cl.[2] ..... H01H 3/54

[52] U.S. Cl. ..... 200/153 G; 200/DIG. 42; 335/166

[58] Field of Search ..... 200/153 G, DIG. 42; 335/166, 191

[56] References Cited

U.S. PATENT DOCUMENTS

| | | | |
|---|---|---|---|
| 3,525,959 | 8/1970 | Ellsworth et al. | 200/DIG. 42 |
| 3,603,755 | 9/1971 | Ranzanigo | 200/153 G |
| 3,605,052 | 9/1971 | Diamond et al. | 200/DIG. 42 |
| 3,621,189 | 11/1971 | Link et al. | 200/153 G |

*Primary Examiner*—Herbert F. Ross

*Attorney, Agent, or Firm*—Haseltine, Lake & Waters

[57] ABSTRACT

The mechanism enables normal separation of the contacts when the handle is moved, even if the contacts are lightly welded together. This prevents the handle from moving if they are solidly welded together. A toggle joint is included between the drive member for the moving contacts and the automatic trip mechanism. The shaft of the toggle is engaged in an opening in an articulated arm.

5 Claims, 10 Drawing Figures

CIRCUIT-BREAKER OPERATING MECHANISM

BACKGROUND OF THE INVENTION

Figure 1:
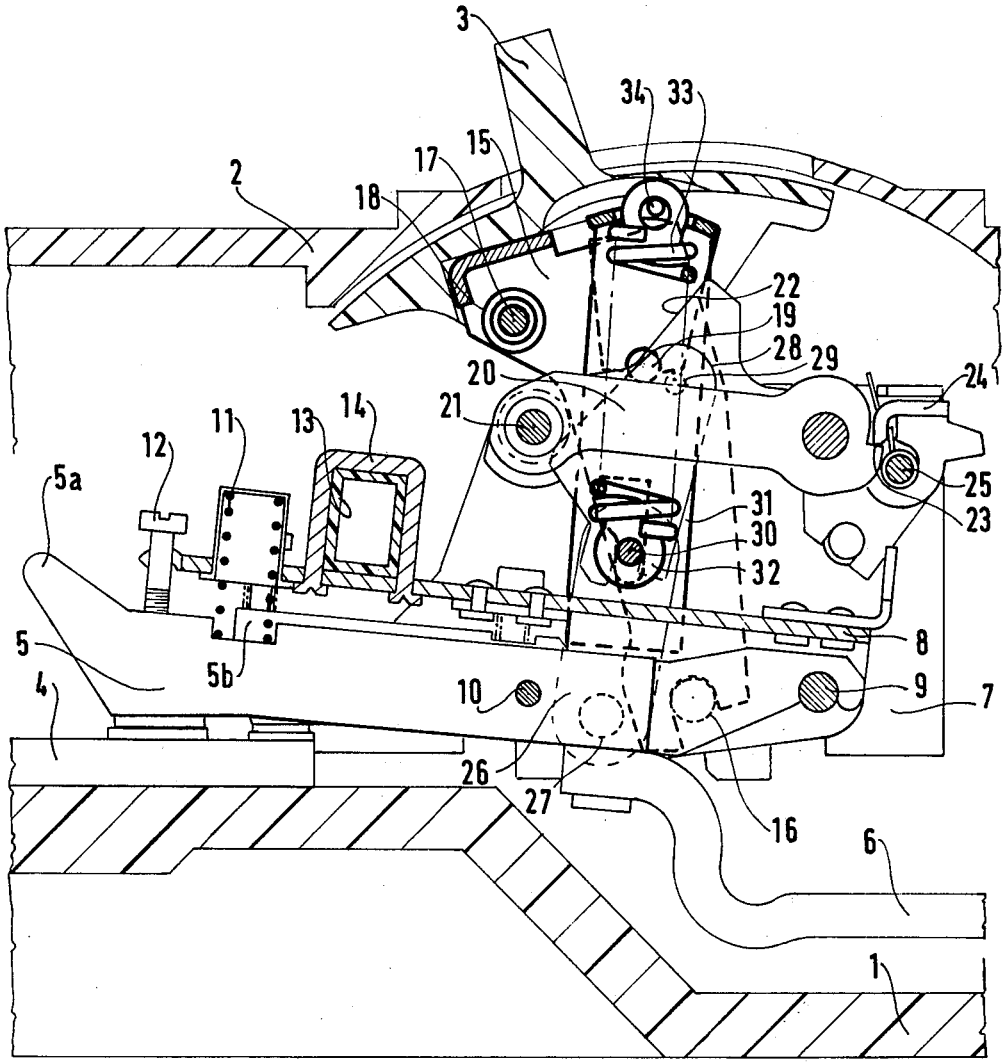

The invention is directed to an operating mechanism for circuit breakers hereinafter referred to as (CB's). More particularly, the invention is directed to low voltage molded-case CB's. Each pole of such CB's comprises a moving contact making or breaking the circuit controlled by the CB, in conjunction with a fixed contact. The moving contacts are associated with a mechanism equipped with a control handle for the opening or closing of the contact pairs, the position of said handle indicating the closed or open condition of the CB. The mechanism comprises a tripping lever associated with an automatic tripping system operated when the current flowing in the circuit reaches abnormally heavy amperage, and thus automatically separating the contacts of the CB. On automatic tripping, the control handle usually adopts a "tripped" position, which is situated between its "closed" and "open" positions. It is then necessary to move the control handle towards its "open" position to reset the mechanism, before it is possible to reclose the CB.

For the safety of the user, it is necessary for the contacts of all poles to be effectively open, when the control handle is in its "CB open" position. This is particularly so, if the CB is equipped for locking in the open condition, namely with a device intended to prevent connection of voltage to the circuit controlled by the CB. It is in fact readily understood, that it would be particularly dangerous if it were possible to lock the control handle in its open position, and thus to believe that the circuit is dead, whereas the contacts of the CB have remained closed.

Devices are known which ensure safety in this respect by placing a bolt or stud in the way of an operating part working with the control handle until the contacts are open, this bolt or stud being moved by a moving contact operating part.

Such a device is described, for example, in French Pat. No. 74 07 529 (publication No. 2,262,859). These devices require locking parts and additional linkages between the control handle and moving contacts of the CB. This takes the form as a special arrangement to prevent control handle locking before normal opening of the contacts. One such arrangement, described in French Pat. No. 74 07 529 consists in making the control handle operate the automatic tripping device, which necessitates yet further additional likages, and complicates operation of the mechanism.

SUMMARY OF THE INVENTION

The main object of the present invention is directed to an operating mechanism which eliminates the disadvantages of the prior art. Still another object is to have an operating mechanism where normal contact opening is ensured at the start of control handle travel, and a mechanical link rigidly locks the control handle with the moving contacts in the contact breaking direction of movement, if contacts have not come away from the fixed contacts within the first part of the handle's travel towards its "open" position.

The present invention is directed to a circuit breaker operating mechanism comprising:

an operating part rigidly locked with the CB control handle and free to move between a "closed" and an "open" position, said operating part carrying a pivot;

an automatic tripping lever which may be latched in a "closed" position;

a linkage system of articulated linking rods and levers between the moving contact driver and said tripping lever;

a snap-action spring anchored at one end with freedom of rotation to a shaft of said linkage system;

and a lever articulated about said pivot carried by the operating part and having an opening, in which the shaft to which one end of the snap-action spring is anchored is engaged, the other end of said spring being linked to said lever, the jointing of said lever, linkage system and spring being such that said mechanism goes from a position of said spring, in which it acts in the CB closing direction, to a position in which it acts in the CB opening direction, within a first, short part of the "open" travel of the control handle, and establishing an inelastic mechanical linkage between the operating part and moving contact driver, in a second part of the control handle's "open" travel, if the moving contacts have not been retracted by the snap-action of the spring during the first, short part of the control handle's "open" travel.

Other features and advantages of the invention will be made apparent with respect to the following description of the accompanying specification, claims and drawings.

Figure 2:
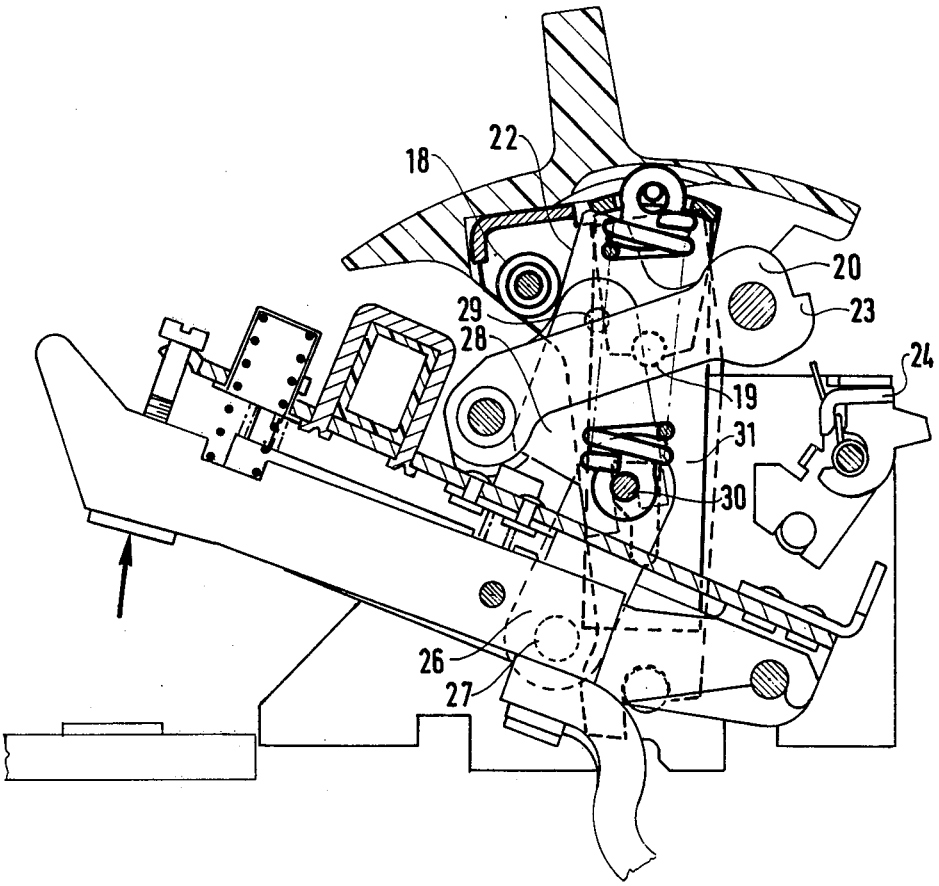
Figure 3:
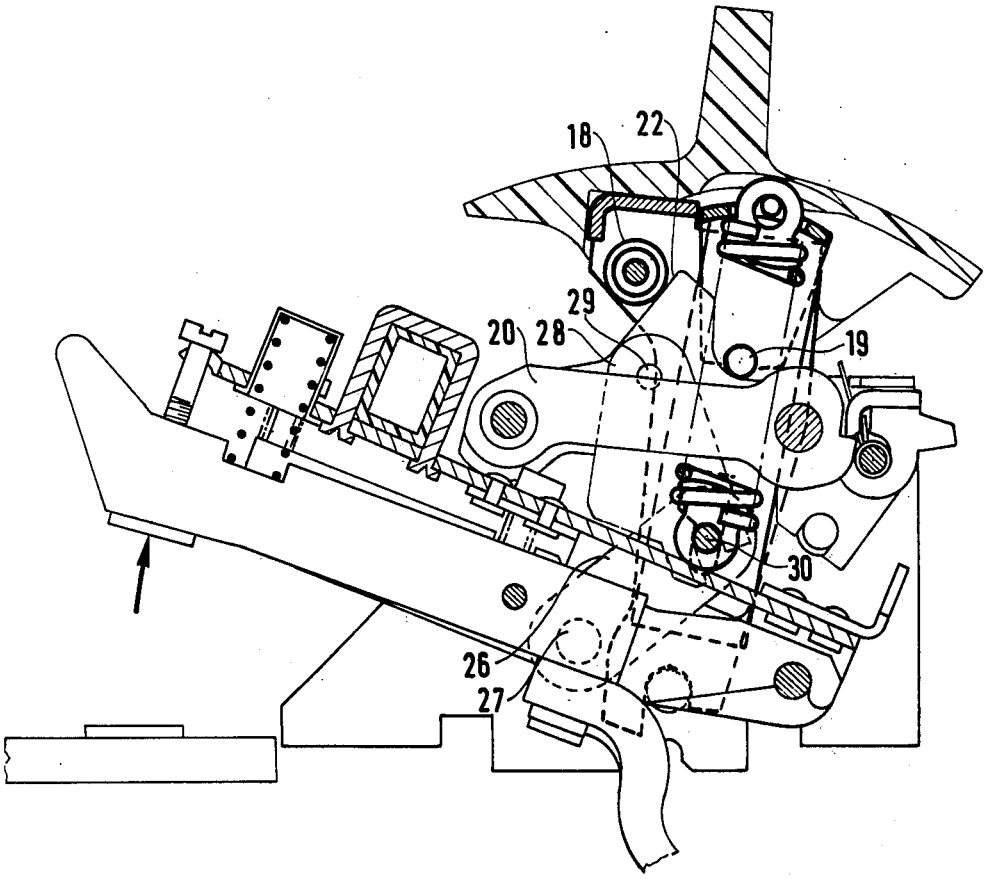
Figure 4A:
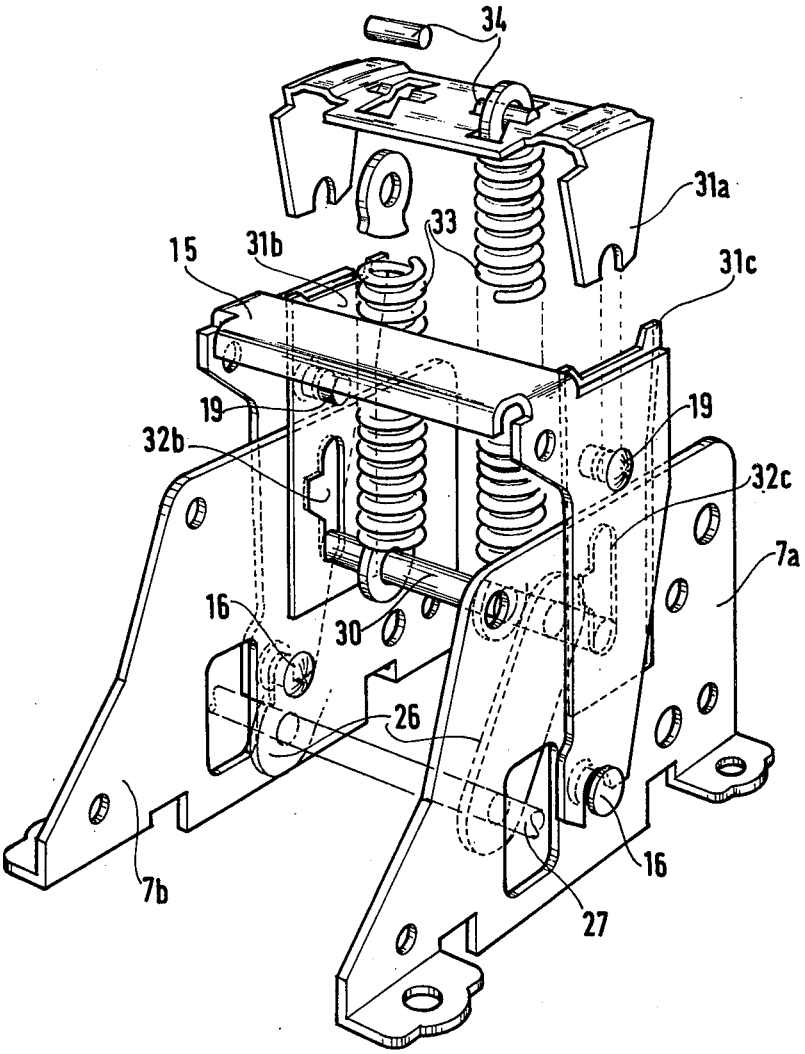
Figure 4B:
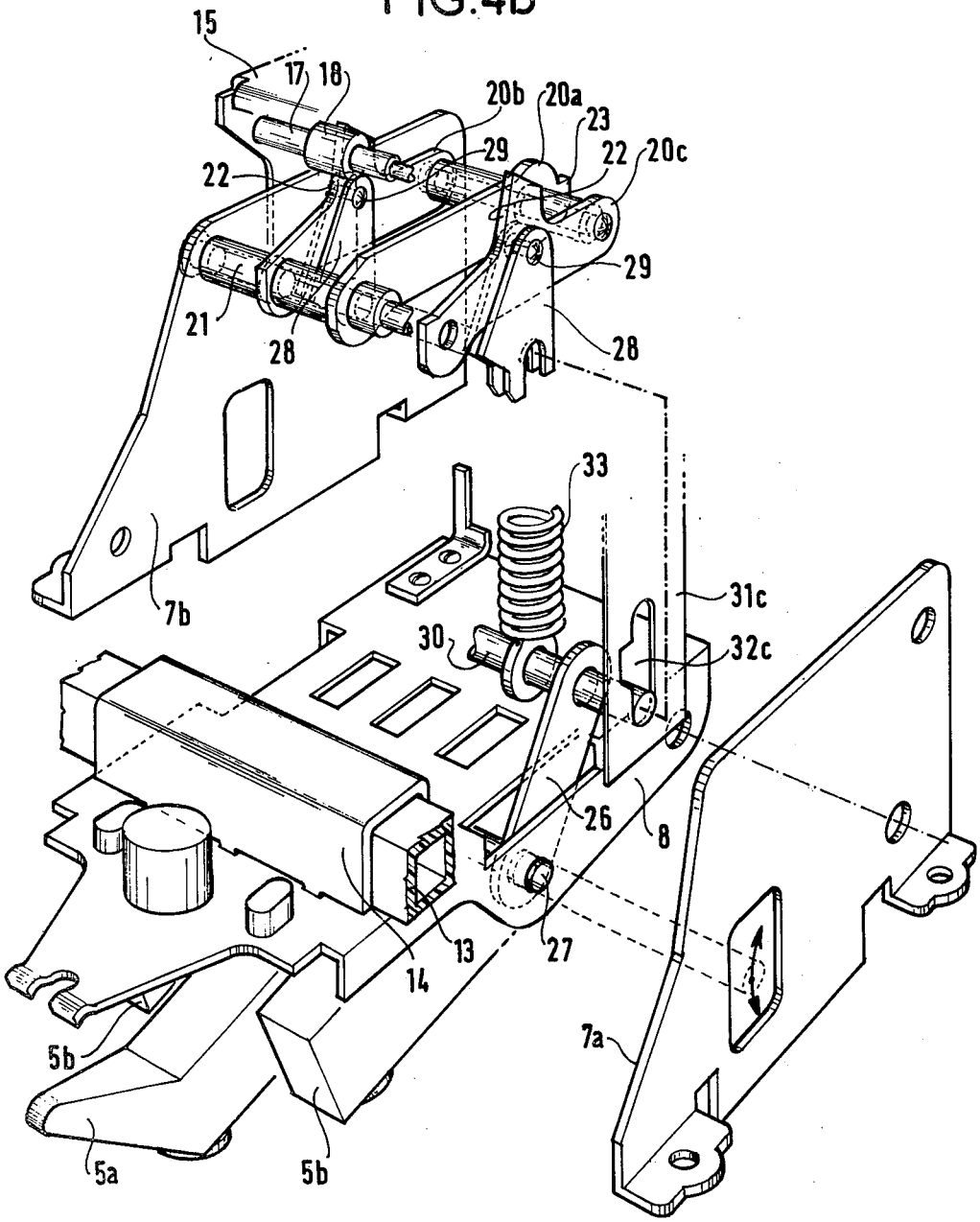

FIGS. 1, 2, and 3, which are cross-sectional drawings of the mechanism according to the invention in respectively its closed, tripped, and open positions;

FIGS. 4*a* and 4*b*, which are exploded view drawings of said mechanism;

FIGS. 5*a* to 5*e*, which are schematic representations of the various operating positions of said mechanism.

DESCRIPTION OF THE INVENTION

With reference to FIGS. 1, 2, and 3, the mechanism according to the invention is mounted in a circuit breaker of known type, possessing a base having a case of molded material 1, a molded cover 2, crossed by control handle 3. For each pole of the CB, a fixed contact 4 is mounted on base 1 to make and break with a moving contact 5, connected to flexible conductor 6. The operating mechanism is carried in frame 7, fixed to base 1.

Mobile contact 5 is attached to driver 8 pivoting on shaft 9 in frame 7. Contact 5 is formed of several independent "fingers" 5*a* and 5*b*. The main contact fingers 5*b* pivot on the same shaft 9 as moving contact driver 8, whereas arc contact 5*a* pivots on shaft 10 carried by moving contact driver 8. A spring 11 is mounted between driver 8 and each of the contact fingers, and set-screw 12 is provided to adjust the gap between each contact finger and driver 8. An insulating bar 13 held by bracket 14 to driver 8 and representing the central pole of the CB provides rigid mechanical linkage with similar contact operating parts pertaining to each pole of the CB.

Control handle 3 is rigidly locked with operating member 15, which bears on pivots 16 in frame 7. Operating member 15 carries a shaft 17, on which are mounted resetting rollers 18. Member 15 also carries studs 19 for the purpose explicited further on.

A tripping lever 20 and its shaft 21 are pivotally-mounted in frame 7. The lever 20 has a resetting slope 22, on which resetting rollers 18 may bear. Tripping lever 20 may engage a detent 24 pivoting on shaft 25 in frame 7, with its step 23. Detent 24 is operated by an automatic tripping device not shown, such as described in French Pat. Nos. 74 05 734 and 76 11 688.

Between tripping lever 20 and moving contact driver 8, there is a linkage system comprising a first set of links 26 joined by shaft 27 to moving contact driver 8, and a second set of links 28 joined to tripping lever 20 by pivots 29. The two sets of links 26 and 28 form a toggle joint around common axis shaft 30.

According to the invention, a lever 31 carried by the pivots 19 in operating member 15 has an opening 32 in which the common axis shaft 30 of the toggle joint is engaged, and springs 33 are streched between the shaft 30 and anchoring pins 34 carried in lever 31, on the side opposite said opening 32, as seen from pivots 19.

Referring to FIGS. 4*a* and 4*b*, frame 7 comprises two-side plates 7*a* and 7*b*. The operating member 15 is in the form of an inverted U, of which the two arms bearing on pivots 16 are external to side-plates 7*a* and 7*b*, whereas the rest of the mechanism is contained between the side-plates.

The tripping lever 20 comprises 3 parallel members 20*a*, 20*b*, and 20*c* joined by spacing rods, the central member 20*a* having the step 23 which may engage detent 24 (FIGS. 1, 2 and 3) whereas members 20*b* and 20*c*, on either side of 20*a*, carry the pivots 29 from which the set of links 28 is suspended, and the resetting slopes 22, on which resetting rollers 18 on shaft 17 in operating member 15 may bear. Lever 31 turning on pivot 19 in operating member 15 comprises 3 members 31*a*, 31*b*, and 31*c*, forming together an inverted U and being assembled around pivots 19 when the mechanism is put together. The two members 31*b* and 31*c* have identical openings, the two constituting the area 32 in which common axis shaft 30 of the toggle joint is engaged.

Moving contact 5 comprises 2 main contact fingers 5*b* and arc contact finger 5*a*. As it is known, in circuit breakers with high-interrupting capacity, the main contact fingers 5*b* make contact after the arc contact finger 5*a*, and break contact before the latter, so that arc contact 5*a* alone is exposed to the effects of arcing at making and breaking.

The operation of the mechansim will now be explained with reference to FIGS. 5*a* to 5*e* which are schematic representations of its various positions, using the same component references as those in FIGS. 1, 2, and 3.

Figure 5A:
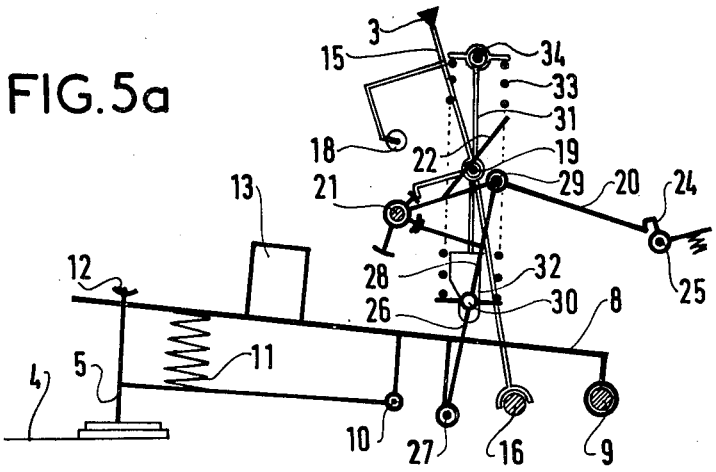

FIG. 5*a* shows the CB in its "closed" position. Tripping lever 20 is engaged by detent 24, and the position of control handle 3 is in the "closed" position. Springs 33 are stretched between common axis shaft 30 and anchoring pins 34 carried in lever 31, turning on pivots 19, and therefore, apply tension between operating part 15 through pivot 19, and linkage system 26,28 through common axis shaft 30. Operating member 15 bearing on pivot 16, and the set of links 28 turning on pivots 19 are thus held against fixed shaft 21, while the position of lever 31 is determined by pivot 19 around which it flexes and by common axis shaft 30 engaged in area 32 of said lever 31. Linkage system 26, 28 is thus held extended, keeping the moving contact driver 8 in its "closed" position and pressing moving contact 5 against fixed contact 4 with the force of spring 11.

Figure 5B:
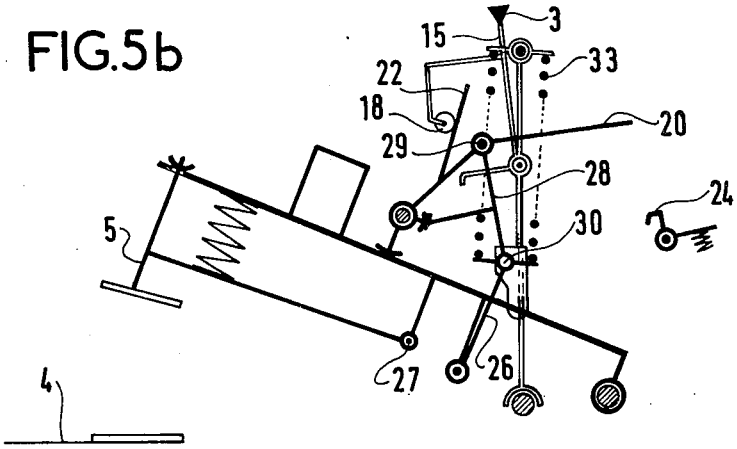

FIG. 5*b* shows the circuit breaker in its tripped position, that is to say, on having been opened by the automatic tripping device. Tripping lever 20 has been released by retraction of detent 24. By reason of the pull of spring 33 on common axis shaft 30, the set of links 28 has thrust pivots 29 in tripping lever 20 upwards, linkage system 26, 28 having folded, moving shaft 27 upwards by means of the set of links 26, thereby completely opening the circuit breaker contacts (4, 5), 5 being attached to driver 8. Control handle 3 has come into its intermediary "tripped" position, resetting rollers 18 carried by operating member 15 coming against the resetting slopes 22 of tripping lever 20. To reset the mechanism, it is then sufficient to move the control handle 3 to the right; rollers 18 then bear on resetting slopes 22, returning tripping lever 20 into engagement with the detent 24. The position adopted by the CB is then as represented in FIG. 5*d*.

Figure 5C:
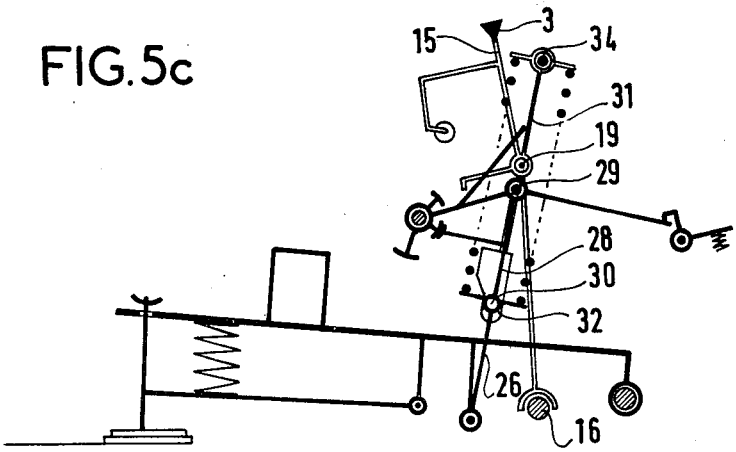

FIG. 5*c* shows the circuit breaker at start of opening by means of the control handle. Starting from the "closed" position shown in FIG. 5*a*, and moving control handle 3 a short distance to the right, causes operating member 15 rotate on pivots 16 and moves pivots 19, mounted on operating part 15, to the right. Lever 13 adopts a new angular position in relation to part 15, but a position still defined by pivots 19 and common axis shaft 30 engaged in area 32. By reason of the respective positions of pivots 16, shaft 30, and pivots 19, the rotation of operating member 15 on pivots 16 amplifies rotation of lever 31 on pivots 19, so that the line of action 30, 34 of springs 33 comes into alignment with pivots 29 at the start of travel of control handle 3. This position, shown in FIG. 5*c*, is that at which the set of links 28 are at "dead center". Beyond this "dead center" position, after going through an angle of friction, spring 33 folds linkage system 26, 28, bringing it into the position shown in FIG. 5*d*, unless the contacts have fused together, which is the case shown in FIG. 5*e*.

Figure 5D:
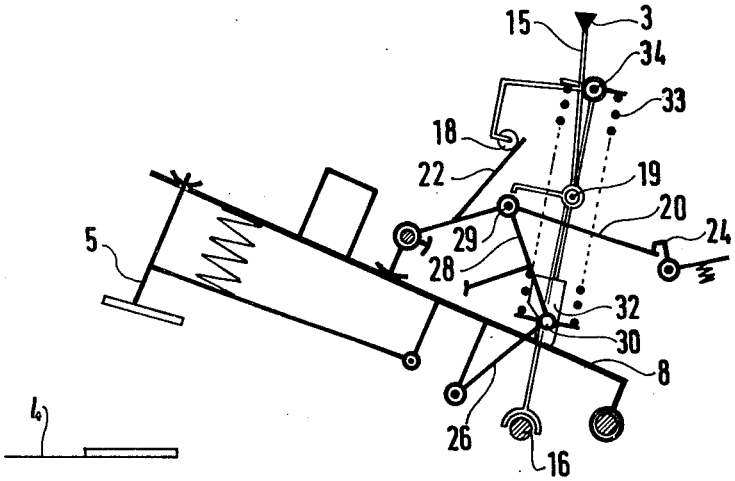

FIG. 5*d* shows the circuit breaker in its "open" position. Tripping lever 20 is engaged by detent 24, whereas control handle 3 is in its "open" position, the same applying to moving contacts 5. As already shown, in leaving the "tripped" position, represented in FIG. 5*b*, the mechanism has been thrust into the position shown in FIG. 5*d* by moving control handle 3 to the right, until tripping lever 20 is engaged by detent 24. Now, starting from the "closed" position shown in FIG. 5*a* and moving the handle to the right, we first bring the mechanism through the position shown in FIG. 5*c*, which is the position of unstable balance for linkage system 26, 28. Continuing movement of control handle 3 to the right, continues to move pivots 19 to the right, bringing the line of action 30, 34 of spring 33 to the other side of pivots 29. Linkage system 26, 28, then folds abruptly around common axis shaft 30, raising moving contact driver and the moving contact 5 into the open position. During this movement, shaft 30 has moved to the right, passing to the other side of the line between pivots 16 and 19, so that the action of spring 33 on operating part 15 is now in the "opening" direction, holding member 15 against the slopes 22 of tripping lever 20, by the intermediary rollers 18, even if the control handle is released. The "open" position of the control handle is therefore a stable position effectively corresponding with the open position of the contacts.

Figure 5E:
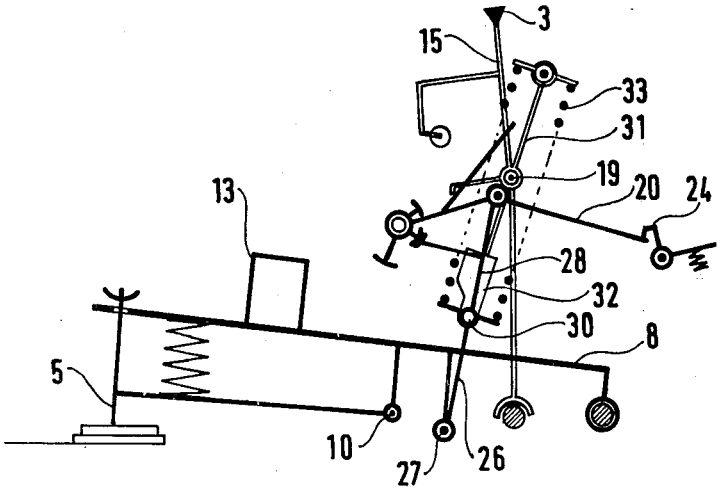

In FIG. 5*e*, the CB is shown with fused contacts, the control handle having been moved in the opening direction. Starting from the "closed" position shown in FIG. 5*a*, and moving control handle 3 to the right, beyond the position of balance (dead center), shown in FIG. 5*c*, creates a tendency of spring 33 to fold linkage system 26, 28 by pulling on shaft 30, but as the contacts are fused together, moving contact driver 8 is held in the "closed" position by rod 10, and movement of shaft 30 is prevented by its linkage with driver 8 through set of links 26 and shaft 27. In continuing to move control handle 3 to the right, the operator continues to move pivots 19 to the right, while lever 31, guided by shaft 30 in area 32, allows member 15 to move until the lower wall of area 32 comes against shaft 30. The force exerted on control handle 3 in the opening direction is then transmitted to shaft 30 along the line of action 30, 19, by lever 31. If the force is sufficient to separate the fused contacts, the result is sudden release of driver 8 and moving contact 5, by the action of spring 33, as soon as the contacts separate. If, on the contrary, the fused contacts resist separation, the opening movement to the right of member 15 is prevented by lever 31 on pivots 19, being blocked by shaft 30 bearing on the lower edge of daylight 32. It is then not possible to move the handle 3 into its "open" position. Moreover, if the handle is released, it will be returned automatically to its "closed" position by the action of spring 33.

In the event of an automatic tripping attempt by detent 24 when the contacts are fused, tripping lever 20 is effectively released, but the tripping action of the lever is halted at a position very close to that shown in FIG. 5*e*, the movement of shaft 30 being prevented by the fuse contacts. Control handle 3 then remains in its "closed" position.

It can thus be seen, that it is not possible to bring the control handle into its "open" position if the contacts remain closed, and it may be noted that the blocked position of the handle (FIG. 5*e*) is distinctly different from the "open" position (FIG. 5*d*). This results from the fact that the mechanism according to the invention provides normal opening of contacts by means of its springs at the very start of control handle travel (FIG. 5*c*).

By reason of the rigid mechanical link provided by insulating bar 13 between the members driving the contacts of each pole, all poles are opened simultaneously, so that it is sufficient for one set of contacts to have fused, to make it impossible for the control handle to be locked into its open position, unless the force exerted in doing so separates the fused contacts.

In particular, the mechanical linkage established in the direction of opening, between operating part 15 and moving contacts driver 8, may be obtained within the general arrangement of the mechanism by other means than the wall area 32 of lever 31 coming against shaft 30 of toggle joint linkage system 26, 28, if the contacts are not normally opened. For example, this linkage may be more direct if part 15 is extended to exercise direct leverage on shaft 27 in moving contacts driver 8, or on rod 13 rigidly attached to said driver 8. More generally, this linkage can be produced by means of a number of variants exercising an equivalent mechanical effect, and such that part 15 cannot be moved into its "open" position completely, if the moving contact driver 8 is prevented from adopting a position in which moving contact 5 has indeed been fully retracted from fixed contact 4.

What is claimed is:

1. A circuit breaker mechanism comprising: an operating member rigidly fixed to a control handle, being free to move from a "closed" to an "open" position, said operating member having pivot means associated therewith; moving contact means free to move from a "closed" to an "open" position; an automatic tripping lever adapted to be latched as said circuit breaker mechanism assumes a closed position; linkage means disposed between the automatic tripping lever and moving contact driver; snap-action spring means anchored at one end to a shaft in said linkage means, and a lever pivotally-mounted on said pivot means carried by said operating member providing an operating area in which said shaft is engaged, the other end of said spring being anchored to said lever; said lever, linkage means, and attachment of said spring being such, to enable said mechanism to proceed from a position in which the spring acts in the direction of breaker closing, to one in which it acts in the direction of breaker opening in response to a first portion of the control handle's travel; and said mechanism acting through said linkage means in the direction of breaker opening established between said operating member and driver in response to a second portion of the control handle travel, when said moving contact means do not break contact under the urging of said snap action spring means during said first, portion of travel of said control handle travel.

2. A circuit breaker mechanism according to claim 1, wherein: said linkage means being defined by a toggle joint.

3. A circuit breaker mechanism according to claim 1, wherein: said linkage means acting in the direction of breaker opening and established between said operating member and the moving contact means during a second portion of the control handle travel in the direction of breaker opening being formed of a link with pivotable means pivoting on said operating member, a lower wall of said pivotable means bearing against a shaft of said linkage means being provided between said contact means and said automatic tripping lever.

4. A circuit breaker mechanism according to claim 1, wherein: mechanical linkage means acting in the direction of breaker opening, being disposed between said operating member and said moving contact means during said second portion of said control handle in the opening direction being formed of means having said operating member and bearing disposed thereon with said moving contact means.

5. A circuit breaker mechanism comprising: an operating member rigidly fixed to a control handle and free to move from a "closed" to an "open" position, said operating member carrying a pivot; moving contact means free to move from a "closed" to an "open" position; an automatic tripping lever adapted to be latched in a closed position; linkage means diposed between the automatic tripping lever and moving contact driver; snap-action spring means anchored at one end to a shaft in said linkage means, and a lever pivotally-mounted on said pivot means carried by said operating member providing an operating area in which a shaft cooperates therewith, said shaft having associated therewith one end of a snap action spring attached thereto, the other end of said spring being anchored to said lever; said lever, linkage means, and attachment of said spring being such, to enable said mechanism to proceed from a position in which the spring acts in the direction of breaker closing, to one in which it acts in the direction of breaker opening in response to a first part of the control handle travel and said linkage means acting in the direction of breaker opening, established between said operating member and driver by cooperative action between said shaft with respect to said operating area, during a second part of said control handle travel in response to the failure of said contact means to break contact by action of said snap action of said spring during said first part of said control handle travel.

* * * * *